United States Patent [19]

Barnabe

[11] 4,092,935

[45] June 6, 1978

[54] PROCESS AND APPARATUS FOR THE INCINERATION OF SOLID FUEL MATERIAL

[75] Inventor: Charles E. Barnabe, Birmingham, Ala.

[73] Assignee: Passavant Corporation, Birmingham, Ala.

[21] Appl. No.: 781,979

[22] Filed: Mar. 28, 1977

[51] Int. Cl.[2] ..... F23G 7/00

[52] U.S. Cl. ..... 110/186; 110/254; 110/304; 110/346

[58] Field of Search ..... 110/12; 432/139, 140, 432/144; 202/117

[56] References Cited

U.S. PATENT DOCUMENTS

| | | | |
|---|---|---|---|
| 2,015,050 | 9/1935 | Baird et al. | 110/12 |
| 2,118,208 | 5/1938 | Lewers | 110/12 |
| 3,968,756 | 7/1976 | Yamada | 110/12 |
| 4,050,389 | 9/1977 | von Dreusche, Jr. | 110/12 |

*Primary Examiner*—Carlton R. Croyle
*Assistant Examiner*—Leonard Smith
*Attorney, Agent, or Firm*—Woodford R. Thompson, Jr.

[57] ABSTRACT

A process and apparatus for the thermal destruction of solid fuel material in a gravity-type multiple hearth furnace having groups of two or more superimposed hearths. Solid fuel is fed to the upper hearth of each group of hearths. Auxiliary fuel is selectively burned in the lower hearth of each group of hearths to maintain the discharge temperature of the exhaust gas flowing from each said upper hearth above the ignition temperature of said gases so that each group of hearths is operated as a combined drying and burning zone. Preheated air for combustion is introduced into the lower hearth of the lowermost group of hearths so that oxygen available for combustion increases as the solid fuel moves downwardly. Ash is removed from the lower hearth of at least the lowermost group of hearths.

11 Claims, 1 Drawing Figure

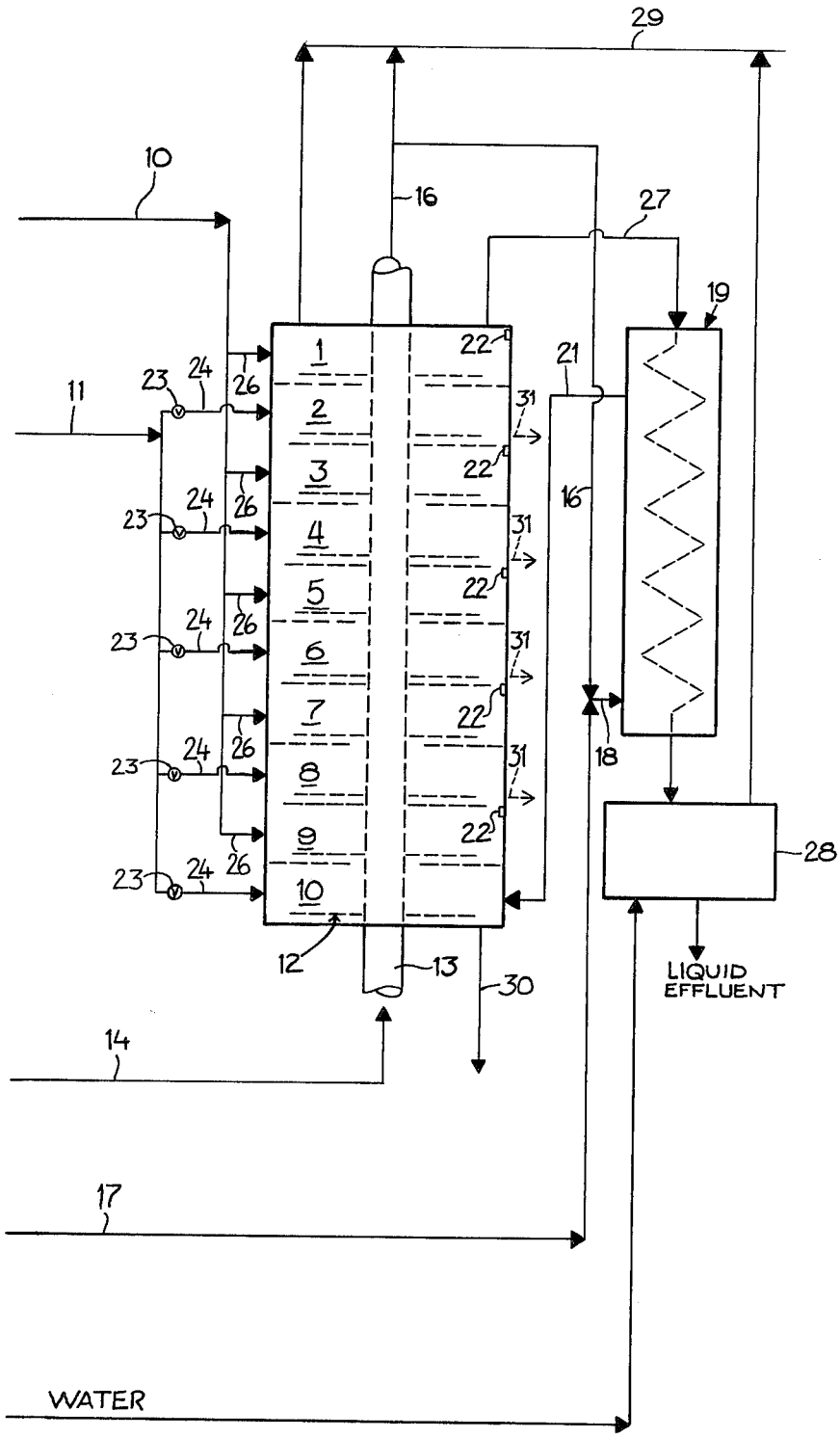
29
10
16
27
19
11
23
24
26
1
2
3
4
5
6
7
8
9
10
22
21
31
16
18
28
12
13
30
LIQUID EFFLUENT
14
17
WATER

PROCESS AND APPARATUS FOR THE INCINERATION OF SOLID FUEL MATERIAL

BACKGROUND OF THE INVENTION

This invention relates to a process and apparatus for the destruction of solid waste material by burning the combustibles in a gravity-type, multiple hearth furnace.

Heretofore in the art to which my invention relates, the conventional operation of such furnaces includes three distinct process functions, namely, drying and preheating the feed materials; burning of the volatiles in the feed materials; and cooling the inert ash. Prior to being burned or oxidized in the burning section, the solid matter flows through a pre-heating zone where it is preheated and dried by the flow of hot waste gas from the burning zone or by other means. Such a process is particularly adapted for the burning of substances that are high in inerts and low in calorific value, such as filter cake derived from sewage sludge filtration, with such solids being burned to nearly 100%. The process preferably takes place in a multiple hearth furnace which is simple to operate and has high thermal efficiency. The waste gas rising from the combustion zone usually passes directly through the preheating zone where it moves in countercurrent flow to the solid fuel which is introduced from the top of the furnace. A disadvantage in such a system lies in the fact that the preheating and drying process takes place at temperatures between 300° and 1100° F which results in the release of gaseous and vaporous substances having odors which rise and mingle with the waste gas and create an environmental nuisance, unless such noxious substances are prevented from contaminating the atmosphere by means of an after-burner or similar system. The addition of such equipment for removal of noxious substances brings about increases in both the initial cost and operating cost of the system and also a decline in the operating efficiency of the system. Heretofore, the cooling of the inert ash in a conventional multiple hearth furnace has been accomplished in the lower hearts where waste heat in the ash is removed by preheating air which is introduced into the furnace through the lowermost hearths thereof.

SUMMARY OF THE INVENTION

In accordance with my invention, I provide an extended oxidation process wherein the noxious, odorous substances released in the preheating and drying of the solid fuel matter are burned before being discharged with waste gas and wherein the efficiency of the system is maintained at an optimum level by extending the portion of the furnace, where combustion can be supported. This is accomplished by limiting the process functions of the furnace to drying and burning only. Since cooling of the ash to recover waste heat is not economical, I eliminate such cooling of the ash whereby the temperature of the incoming air can be increased by preheating the air to a temperature ranging from 1000° to 1200° F in a heat exchanger wherein waste heat is recovered from the furnace exhaust gas. In accordance with my invention, the furnace is made up of drying and burning zones of at least two hearths, each of which includes an upper hearth and a lower hearth with solids being fed to the upper hearth and auxiliary fuel being fed to the lower hearth with automatic control of exhaust temperature from the upper hearth. This type control provides maximum heat transfer with uniform temperatures being maintained throughout the combustion system ranging from 1250° to 2000° F. This also permits controlling the furnace minimum exhaust temperature whereby it ranges from 1250° to 1600° F without producing exceedingly high temperatures on the burning hearths.

DESCRIPTION OF THE DRAWING

Apparatus embodying features of my invention and which may be employed to carry out my improved process is illustrated in the accompanying drawing, forming a part of this application in which:

The single view shows schemetically a ten hearth, gravity-type multiple-hearth furnace having five drying and burning zones with two hearths per zone.

DETAILED DESCRIPTION

Referring now to the drawing for a better understanding of my invention, my combustion system embodies multiple pairs of superimposed hearths numbered from 1 to 10 from the top to the bottom of the furnace. Solid waste material containing combustibles, such as filter cake, is fed into the upper hearth of each pair of superimposed hearths so that the material is preheated and dried in the upper hearth and then passes to the hearth subjacent thereto where it is burned. That is, the solid waste material, such as filter cake, is introduced by supply means 10 to the odd numbered hearths 1, 3, 5, 7 and 9 or preferably on the solids inflow hearths. Auxiliary fuel and combustion air are introduced by supply means 11 selectively and in controlled amounts to the lower hearths of each group of superimposed hearths to maintain the discharge temperature of gases flowing from each of the upper hearths above the ignition temperature of the gases. That is, controlled amounts of an auxiliary fuel mixture are introduced into the even numbered hearts 2, 4, 6, 8 and 10.

The furnace assembly or rabble, indicated generally at 12 is supported on a hollow, centrally disposed shaft 13, as shown. Cooling air is introduced into the lower end of the hollow shaft 13 by a conduit 14 and is removed from the upper end of the hollow shaft 13 by a conduit 16. Combustion air is supplied by a conduit 17 and is mixed with the preheated air passing through the conduit 16 prior to passing into the inlet 18 of a heat exchanger 19. Preheated air is discharged from the heat exchanger 19 through a conduit 21 and is introduced into the lowermost hearth 10 of the furnace where it is further heated by combustion of the volatiles in the filter cake fed onto hearth 9. The exhaust temperature from hearth 9 is controlled by the burning of auxiliary fuel on hearth 10, as required to maintain an exhaust temperature ranging from 1250 to 1400° F. The discharge temperature of the gases flowing from each of the upper hearths is above the ignition temperature of the gases flowing therethrough. Accordingly, hearths 9 and 10 comprise a drying-burning zone, as does hearths 7-8, 5-6, 3-4 and 1-2. The exhaust gas from hearths 1, 3, 5, 7 and 9 is controlled by a suitable temperature sensor 22 which regulates the flow of the auxiliary fuel mixture selectively to the hearths 2, 4, 6, 8 and 10. Suitable control valves 23 are provided in branch conduits 24 for the supply means 11 which supply auxiliary fuel and combustion air selectively to the hearths 2, 4, 6, 8 and 10. Solid waste material is introduced into each of the hearths 1, 3, 5, 7 and 9 through branch lines 26, as shown. Accordingly, the solid waste material and the auxiliary fuel mixture are fed into the upper and lower hearths, respectively, of each pair of superimposed hearths in a generally horizontal plane, as shown. The exhaust gas temperatures from the even numbered hearths 2, 4, 6, 8 and 10 normally ranges from 1600° to 2000° F. Accordingly, autogenous combustion of the gases is supported throughout the furnace. This is especially true in view of the fact that I provide extended oxidation throughout the furnace. That is, the available oxygen increases as the material being burned passes downwardly toward the lower end of the furnace assembly.

The exhaust gas from the uppermost hearth 1 flows through a conduit 27 to the heat exchanger 19 and is cooled as it preheats the combustion air flowing through the furnace and is discharged through the conduit 21. Preferably, the exhaust gas introduced through conduit 27 passes through the tube side of the heat exchanger 19 countercurrent to the inlet air, where it preheats the inlet air to a temperature ranging from approximately 1000° to 1200° F.

The exhaust gas from the heat exchanger 19 is further cooled and entrained solids are removed therefrom by a suitable separator unit 28 to comply with air emission specifications. Also, if desired, waste heat may be employed to reheat the cooled gas passing through a conduit 29 to the usual stacks, for plume control.

The preheated air entering the lowermost hearth 10 is heated further by the heat released from the combustion of volatile materials in the solid waste, which is fed to the hearth 9 immediately above it. The gases flow from hearth 10 to hearth 9 and provide the heat to dry the waste material and heat it to its ignition temperature which ranges from 1250° to 1400° F. The exit temperature of the gas flowing from hearth 9 to hearth 8 is automatically controlled as described hereinabove to provide a minimum temperature ranging from 1250° to 1400° F by burning auxiliary fuel on the lower hearth 10. The next two superimposed hearths 7 and 8 are operated in the same manner whereby solid waste is fed onto hearth 7 and auxiliary fuel is fed onto hearth 8, if required, to control the gas exhaust temperature from hearth 7. The other superimposed pairs of hearths are operated in the same manner. Normally, the filter cake will be fed to the odd-numbered hearths and auxiliary fuel will be fed on the even-numbered hearths. The feed is normally distributed evenly to the odd-numbered hearths, but may be adjusted, if desired for control purposes. For example, at 1000 pounds per hour feed in a fourth hearth furnace, 500 pounds would be fed to each odd-numbered hearth 1 and 3, and auxiliary fuel would be provided on hearths numbered 2 and 4.

Multi-point feed to the drying-burning zones assures total combustion of the volatile materials. The excess air in the lowermost drying-burning zone can be as high as 10 to 13 times the theoretical requirement in a 14 hearth furnace with the total flow of air ranging from approximately 1.25 to 2 times he theoretical requirement for combustion.

The ash may be removed from the lowermost hearth 10 through an outlet 30 or may also be removed from other selected lower hearths 2, 4, 6 and 8. Where the ash is removed from selected lower hearths of the superimposed pairs of hearths, ash discharge outlets 31 are provided, as shown in dotted lines.

By providing a constant operating temperature throughout the furnace, the maximum mean temperature employed greatly increases the heat transfer and feed rate from the usual 7 to 10 pounds per hour per square foot of hearth area to approximately 20 pounds per hour per square foot of hearth area.

From the foregoing, it will be seen that I have devised an improved process and apparatus for the oxidation of solid fuel material, such as filter cake. By maintaining the exhaust temperature from each of the combined drying and burning zones above the ignition temperature of the volatiles in the solids passing therethrough, I assure drying, preheating and burning of the materials to an inert ash and non-noxious gas. Also, by preheating the inlet air to the furnace with waste heat from the furnace in a heat exchanger, I greatly improve the efficiency of operation of the furnace. Furthermore, by introducing the preheated air into the lower end of the furnace and introducing auxiliary fuel selectively into the lower hearth of the superimposed groups of hearths, the air flows countercurrent to the ash through the drying and burning zones whereby the available oxygen for combustion increases as the solids move downwardly through the furnace. Accordingly, extended oxidation is provided and at the same time each combined drying and burning zone provides the essential conditions to support combustion of the volatiles, such as temperature, oxygen, retention time and contact between the materials and the burning means.

I wish it to be understood that I do not desire to be limited to the exact details of the process and apparatus shown and described, for obvious modifications will occur to a person skilled in the art.

What I claim is:

1. A process for the combustion of solid waste material containing combustibles in a gravity-type furnace having multiple groups of superimposed hearths, the improvement comprising:

(a) feeding solid waste material into the upper hearth of each said group of superimposed hearths so that said material is preheated, dried and burned within said group of superimposed hearths, (b) selectively supplying controlled amounts of an auxiliary fuel to the lower hearth of each said group of superimposed hearths to maintain the discharge temperature of gases flowing from each said upper hearth above the ignition temperature of said gases, and (c) removing ash from the lower hearth of at least the lowermost group of superimposed hearths.

2. The process as defined in claim 1 in which the flow of auxiliary fuel into said lower hearth of each said group of superimposed hearths is regulated to obtain a minimum discharge temperature of the gases flowing from the upper hearth superjacent thereto ranging from approximately 1250° to 1400° F.

3. The process as defined in claim 1 in which preheated air for combustion is introduced into the lower hearth of the lowermost group of said superimposed hearths with said air for combustion flowing upwardly through said groups of superimposed hearths.

4. The process as defined in claim 3 in which said preheated air is heated to a temperature ranging from 1000° to 1200° F prior to being introduced into said lower hearth.

5. The process as defined in claim 1 in which said solid waste material and said auxiliary fuel are fed into the upper and lower hearths, respectively, of each group of superimposed hearths in a generally horizontal plane.

6. The process as defined in claim 1 in which the temperatures throughout the furnace range from approximately 1250° F to 2000° F.

7. The process as defined in claim 1 in which all inlet air is introduced into the lowermost group of hearths in an amount ranging from approximately 10 to 13 times the theoretical amount required for combustion in the lowermost group of hearths in a 14 hearth furnace with the total air introduced into the combustion system ranging from approximately 1.25 to 2 times the theoretical requirement for combustion.

8. The process as defined in claim 1 in which ash is also removed from selected lower hearths of said superimposed groups of hearths.

9. In apparatus for the disposal of solid waste material containing combustibles in a gravity-type furnace having multiple groups of superimposed hearths, (a) means for feeding solid waste material into the upper hearth of each said group of superimposed hearths so that said material is preheated, dried and burned within said group of superimposed hearths, (b) means for introducing preheated air for combustion into the lower hearth of the lowermost groups of said superimposed hearths with said air for combustion flowing upwardly through said groups of superimposed hearths, (c) means for supplying auxiliary fuel to the lower hearth of each said group of superimposed hearths, and (d) means regulating the flow of said auxiliary fuel into said lower hearth of each said group of superimposed hearths to maintain the discharge temperature of gases flowing from each said upper hearth above the ignition temperature of said gases.

10. Apparatus as defined in claim 9 in which the means for regulating the flow of said auxiliary fuel into said lower hearth comprises a temperature sensor in each said group of superimposed hearths.

11. Apparatus as defined in claim 9 in which the means for introducing preheated air for combustion into the lower hearth of the lowermost group of said superimposed hearths comprises, (a) a heat exchanger, (b) means for conveying exhaust gases from the upper hearth of the uppermost group of said superimposed hearths through said heat exchanger, and (c) means for circulating the air to be preheated through said heat exchanger.

* * * * *